US008127672B2

(12) United States Patent
Müller et al.

(10) Patent No.: US 8,127,672 B2
(45) Date of Patent: Mar. 6, 2012

(54) METHOD AND DEVICE FOR CONTROLLING AT LEAST ONE ROTATING COMPONENT OF A PRINTING PRESS

(75) Inventors: Klaus Georg Matthias Müller, Remlingen (DE); Günther Ewald Gabriel, Hettstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 46 days.

(21) Appl. No.: 12/735,571

(22) PCT Filed: Oct. 8, 2008

(86) PCT No.: PCT/EP2008/063474

§ 371 (c)(1),
(2), (4) Date: Jul. 28, 2010

(87) PCT Pub. No.: WO2009/100783

PCT Pub. Date: Aug. 20, 2009

(65) Prior Publication Data

US 2010/0319559 A1 Dec. 23, 2010

(30) Foreign Application Priority Data

Feb. 11, 2008 (DE) ..... 10 2008 000 271
Apr. 22, 2008 (DE) ..... 10 2008 001 309

(51) Int. Cl.
*B41F 5/00* (2006.01)

(52) U.S. Cl. ..... 101/216; 101/483; 101/484; 101/487

(58) Field of Classification Search ..... 101/216, 101/484, 483, 491, 487
See application file for complete search history.

(56) References Cited

U.S. PATENT DOCUMENTS

| | | | |
|---|---|---|---|
| 5,694,848 | A | 12/1997 | Palmatier |
| 7,004,070 | B2 | 2/2006 | Schneider et al. |
| 7,021,215 | B2 | 4/2006 | Schneider et al. |
| 7,089,855 | B2 | 8/2006 | Schneider et al. |
| 7,523,706 | B2 | 4/2009 | Schneider et al. |
| 7,740,185 | B2 | 6/2010 | Müller |

FOREIGN PATENT DOCUMENTS

| | | | |
|---|---|---|---|
| DE | 44 29 520 | A1 | 2/1996 |
| DE | 10 2004 006 231 | B3 | 8/2005 |
| DE | 10 2005 005 303 | A1 | 7/2006 |
| EP | 0 383 295 | A2 | 8/1990 |
| EP | 0 886 577 | B1 | 12/1998 |
| JP | 60161152 | A | 8/1985 |
| WO | 03/045695 | A1 | 6/2003 |
| WO | 2004/054805 | A1 | 7/2004 |

*Primary Examiner* — Matthew G Marini
(74) *Attorney, Agent, or Firm* — Mattingly & Malur, P.C.

(57) ABSTRACT

At least one rotating component of at least one printing unit is regulated to a target value for a temperature, representing the component temperature, by a temperature controller. At least one drive of an assembly of the printing machine is regulated or controlled, on the basis of a target value for a rotational speed prescribed by a command level, with respect to a rotational speed to be maintained. For at least an operating phase transient, relative to the rotational speed, a target value prescribed by the command level, is modified. This is done by considering at least one member of a route and/or a control model characterizing the temperature controller and/or by using a rule ($F_2(\theta)$) for a dependence of a rotational speed on a temperature. The modified target rotational speed serves as a prescribed value for the rotational speed of the drives.

16 Claims, 8 Drawing Sheets

METHOD AND DEVICE FOR CONTROLLING AT LEAST ONE ROTATING COMPONENT OF A PRINTING PRESS

CROSS-REFERENCE TO RELATED APPLICATIONS

This application is the U.S. national phase, under 35 U.S.C. 371, of PCT/EP2008/063474, filed Oct. 8, 2008; published as WO 2009/100783 A2 and A3 on Aug. 20, 2009, and claiming priority to DE 10 2008 000 271.2, filed Feb. 11, 2008, and to DE 10 2008 001 309.9, filed Apr. 22, 2008; the disclosures of which are

FIELD OF THE INVENTION

The present invention is directed to a method and to a device for controlling a printing press. At least one rotating component of at least one printing couple is controlled with respect to a target value for a temperature, which represents the component temperature, by the use of a temperature control device.

BACKGROUND OF THE INVENTION

A device and a method for controlling the temperature of a component in a printing press are known from DE 44 29 520 A1. The component is temperature controlled by the use of an at least partially circulating fluid. A control element, with which a mixing ratio can be adjusted at an intake point for two fluid streams having different temperatures, is controlled through a temperature measuring site that is located between the intake point for the fluid streams and the component itself.

EP 08 86 577 B1 discloses a device and a method for controlling the temperature of a component. A component temperature is monitored via sensors, and the measured value is provided to a control unit. If the temperature measured at the component deviates from a target value, the control unit will decrease or will increase the temperature of a cooling medium in a cooling unit by a certain amount and wait for a defined period of time. It will then repeat the measurement and the listed steps until the target value is reached again.

EP 03 83 295 A2 discloses a temperature controlling device for printing presses. A temperature of the fluid in an intake line and a surface temperature of the component to be temperature controlled are detected and these temperatures are supplied to a control device. Based upon these temperatures, and, if applicable, also based upon prescribed influencing parameters, such as the paper that is used, the ratio of wetting agent, and target temperatures, for example, a control variable, which is usable for controlling a mixing motor, is determined. This control variable adjusts the ratio between circulating fluid and freshly supplied temperature controlled fluid.

JP 60-161152 A discloses a cooling device of a roller to be temperature controlled. A surface temperature of the roller and a fluid temperature in the inflow path are measured. These values are supplied to a control device for comparison with a target value and for use in controlling a valve.

In WO 2004/054805 A1, a measured temperature, which at least approximately represents the temperature of the component, and especially in the case of a roller, a temperature that represents the surface temperature of the roller, is adjusted to, and/or is maintained at a certain target value through temperature control via a temperature control device. This is carried out using a cascade-type controller structure. Elements of the control or path model are provided in the closed loops.

From WO 03/045695 A1, it is known that for different production speeds, different target temperature values or different maximum values can be prescribed.

DE 10 2005 005 303 A1 relates to a system for controlling the temperature of components of a printing press. It is proposed, among other things, that an intended change in the press speed can be delayed in its execution, such as, for example, by appropriate programming in an evaluation unit, until a certain temperature is reached on the roller.

In DE 10 2004 006 231 B3 a method of transporting dampening agent from a first roller to a forme cylinder is known.

Roller surface temperatures can be controlled only very slowly, in comparison with the ability to control the rotational speed of a press. Therefore, despite various precontrol and derivative action measures, with faster changes taking place in rotational speed, temperatures can lag behind to a greater or lesser extent. In terms of interface technology, temperature control has heretofore been based upon the current rotational press speed, and will therefore attempt to adapt the temperature to it. Ink densities during transient operating phases, such as, for example, during run-up and cool-down phases, therefore may not remain constant enough, or rotational speed may be changed only extremely slowly.

SUMMARY OF THE INVENTION

The object of the present invention is to devise a method and a device for controlling a printing press.

The object of the present invention is attained according to the present invention through the provision of a temperature control device for controlling the temperature of at least one rotating component of at least one printing couple. A temperature which represents the component temperature can be controlled, with respect to a target value. At least one drive of an assembly of the printing press can be regulated and/or controlled with respect to a rotational speed that is to be maintained on the basis of a target value for the rotational speed, as prescribed by a control level. A processing or control device is provided. A first rule, for dependence of a temperature on a rotational speed, and a second rule, for dependence of a rotational speed on a temperature, are provided. A target value for rotational speed provided by the control level can first be converted, using the first rule, to a target value for a temperature. Then, using the second rule, this target value can be converted to a modified target value for rotational speed, after passing through a path and/or a control model of the temperature control device.

The benefits to be achieved with the present invention consist particularly in that, even for operating phases that are transient in terms of press speed, a constant ink density can be achieved on the printed product. The present method ensures that the correlation between rotational speed and surface temperature for constant ink density, or for ink viscosity control over an ink curve, is such that, ideally, the surface temperature is adapted to the rotational speed of the press at all times.

In the method in accordance with the present invention, the dynamic response of the rotational speed profile and the dynamic response of the temperature profile are better adjusted to one another. This allows the static ink curve correlation to be adequately realized, even in dynamic cases.

In the solution presented in accordance with the present invention, the change in press rotational speed that is applied is adjusted to the temperature change that can actually be achieved in the process. Specifically, it is based, for example, upon the temperature profile of all relevant temperature control loops that are involved in the process which can be achieved most slowly with respect to rate of change or dynamic response.

Because of essentially high signal quality requirements, with respect to the acceleration curve profiles of controlled electric drives, rather than basing this on a measured temperature profile, it is particularly advantageous to calculate a model profile for a feasible temperature/response profile for the process, with that calculated model profile being smooth in terms of signals, in a control device, such as, for example, in a processor of the temperature control device, and based upon known path model parameters. From this model profile, the required suitable profile of target value for rotational speed, which is smooth in terms of signals, can then be determined. This latter calculation is preferably carried out by determining the inverse relation to the dependence of temperature on rotational speed, which is also called the "ink curve", of the temperature control loop that is chosen for controlling the rotational speed of the press.

According to the method of the present invention, the profile for rotational speed is no longer provided directly by the control level to the drives or to their drive controls. Instead, first the technologically desired modified profile for the rotational speed target value is determined from this profile. This can be generated, for example, in a separate controller or processing unit or in the controller or processing unit of the temperature control device, and can then be either returned to the control level and from there can be provided to the drives or drive controller, or can be provided directly to the drive controller. It is this modified profile for the rotational speed target value that is then used, at least during transient operating phases, to prescribe the target value for rotational speed of the printing press.

Thus, in the control process of the present invention, for each relevant temperature control loop, a first transformation or ink curve, in which rotational speed is converted to temperature, takes place. Then, this temperature profile is dynamically looped with a model of the closed temperature control path, running times, response times, resulting in the associated physically feasible delayed temperature profile, after which an inverse transformation takes place. An inverse relation of the ink curve, in which temperature is converted back to rotational speed.

In a particularly advantageous embodiment of the present invention, this temperature profile is dynamically looped using the model of the closed temperature control path, running times, response times, which is present, in any case, in terms of parameters.

In another advantageous embodiment of the invention, all of the individual control units, for use in controlling the temperature of the same type of rollers in a printing unit or in a printing tower, are also established as processes in a processing unit, such as, for example, as a computer, in the temperature control assembly. The aforementioned control involving transformation and inverse transformation can also advantageously be incorporated as a process in this processing unit.

The concept of the present invention can be used with particular advantage in conjunction with a multi-loop feedback control. Such a control operates very rapidly and stably, even with longer transport paths for the temperature control medium. The short reaction time enables its use in applications and in processes that have high dynamic ratios and thus also have a steeper slope for the adjusted rotational speed during transient operating phases. Thus, the present temperature control is also highly advantageous in cases in which rapid changes to a target temperature value must be duplicated, and/or in cases in which external conditions, such as, for example, energy input, as a result of friction or external temperature, change very rapidly.

When, at the end of a transient phase, the final rotational speed is reached, the predetermined target value for rotational speed can advantageously be transferred, unaltered, to the drives or drive control, such as, for example, to the section computer.

If more than one temperature control unit or printing unit is present, the minimum can be determined from the existing target/prescribed values and can be used for purposes of modification.

A corrected target value for rotational speed is advantageously determined separately for rollers of eight printing couples, for example. The minimum resulting from these eight values is then processed to obtain the modified target value. This value is transmitted to the control level or to the drive control as a new control target value for rotational speed.

The "temperature curve" $n(\theta)$ preferably has a continuous slope, and the maximum temperature for determining the associated rotational speed is limited to a value lower than the maximum.

In a further development, the function at the zero point can have a discontinuity. In this case, the temperature value is raised at the rotational speed 0, so that in a warm environment no condensation is produced.

BRIEF DESCRIPTION OF THE DRAWINGS

Preferred embodiments of the present invention are represented in the set of drawings and will be specified in greater detail in what follows.

The drawings show.

DESCRIPTION OF THE PREFERRED EMBODIMENTS

Figure 1:
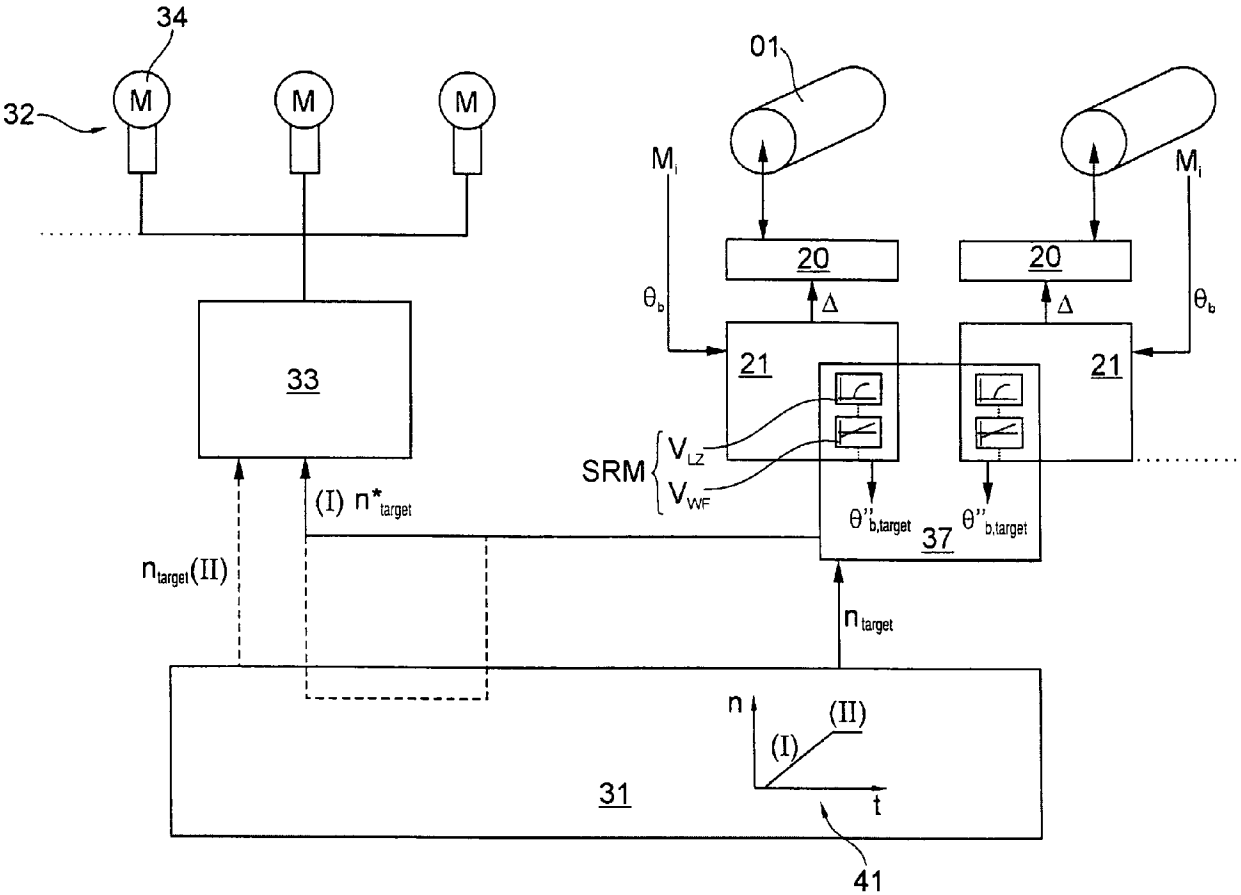
FIG. 1 a schematic representation of a control system in a printing press with rollers which are to be temperature controlled and with controlled drives.

A printing press has at least one component, such as a roller 01, and in particular, has an ink guiding roller 01 of a printing couple, which is not specifically shown. This roller 01 can be configured as a roller 01 of an inking unit, for example, and particularly can be embodied as an anilox roller 01, or it can be configured as a cylinder 01 of the printing couple, for example, and particularly as a forme cylinder 01. The printing press further has a control level 31 with a control station, for example, and also with a press controller, through which a press speed "n", identified here, for example, as the press rotational speed "n", or the rotational speed "n" for short, is or can be prescribed in one or more drives 32, for example drive motors 32, such as, for example, with controller and motor 34) of the printing press as the target value for rotational speed $n_{target}$. The predetermined value for the press rotational speed "n" is usually provided, as indicated by a dashed line, by the control level 31, such as, for example, by a processor or by a section computer of the control level 31, for example either directly to drive controllers of one or more drives 32, or advantageously to a higher-level drive control 33, which generates an electronic control axis, and particularly generates a virtual control axis. Stated more simply, the drive control 33 generates a continuous rotation of a virtual angular position, in correlation to the prescribed target value for rotational speed $n_{target}$. The higher-level drive control 33 can be a drive control 33 that is assigned to an assembly or to a drive motor 32, which acts or functions a master. It can also represent a supplementary drive control 33, which is not directly assigned to any of the drive motors 32.

The device and the method of operating the printing press, in accordance with the present invention, as will be described below, can be used particularly advantageously together with a printing couple for waterless offset printing, such as, for example, with a printing couple which does not use a dampening agent. In the printing couple, and particularly in such a printing couple for waterless offset printing, the quality of the ink transfer is extremely highly dependent upon the temperature of the ink and/or the temperature of the ink guiding surfaces, such as, for example, the outer surface of rollers 01 or cylinders 01. Furthermore, the quality of ink transfer is also sensitive in relation to a nip speed, or in other words, is sensitive to the press rotational speed "n".

As has been described in WO 2004/054805 A1, which was mentioned previously, and among other publications, through the use of temperature control with a temperature control device, a measured temperature $\theta_b$ which at least approximately represents the temperature of the component 01, and in the case of a roller 01, a measured temperature and particularly a temperature $\theta_b$ which represents the surface temperature of the roller 01, at least approximately, is to be adjusted and/or is to be maintained at a certain target value $\theta_{b,target}$. This is accomplished by measuring the most representative temperature $\theta_b$ possible, on one hand, and by controlling the intake or the removal of energy in the form of heat, on the other. It is already known from WO 03/045695 A1, for example, that for different production speeds, different temperature target values or different maximum values may be prescribed.

The concept represented schematically in FIG. 1 now provides that, at least for an operating phase I of a change in rotational speed, such as, for example, during phase I of start-up of the printing press, a target value for rotational speed $n_{target}$ as prescribed by the control level 31, on the press control, is modified taking into account at least one element of a path and/or a control model SRM of the temperature control device, such as, for example, at least a precontrol element for the running time $V_{LZ}$, or running time element, for short and/or using a rule $F_2(\theta)$, after which the then modified target value for rotational speed $n^*_{target}$ is provided to the drive control 33 or to the drives 32 as a prescribed value. It is thus insured during start-up of the printing press, such as, for example, during a change in the press rotational speed or production speed, the response time of temperature control does not lead to significant deviations between the actual component temperature and the temperature desired for the respective press rotational speed n, at target value $\theta_{b,target}$. Start-up, which occurs, for example, along a velocity slope 41, which is stored in the control level 31, and which may be referred to as a velocity curve, is adapted here to the dynamic response of temperature control using the rule $F_2(\theta)$. The rule $F_2(\theta)$ is preferably stored. However, it can be modified, for example, by an interface or an input option.

In reference to FIG. 1 and FIG. 2, the concept for general applications will now be described in greater detail:

The temperature of the component 01 is controlled by the operation of a temperature control device 20, the control element of which is adjusted by a control unit 21. The temperature control device 20 with the corresponding control element and the assigned control unit 21 can also be combined under the term temperature control device 20, 21.

At a measuring point $M_i$ of the component 01, or along a control path 02, such as, for example, along a temperature control path 02, as will be described below, of the temperature control device which controls the temperature of the component 01, a measured value for the temperature $\theta_b$, which represents the component temperature as accurately as possible, is to be controlled. Depending upon control engineering or technical complexity, the temperature $\theta_b$, which represents the component temperature, and which is to be controlled, can be measured on the component itself 01, can be measured near the component, or can be measured farther away from the component along the control path 02.

Figure 2:
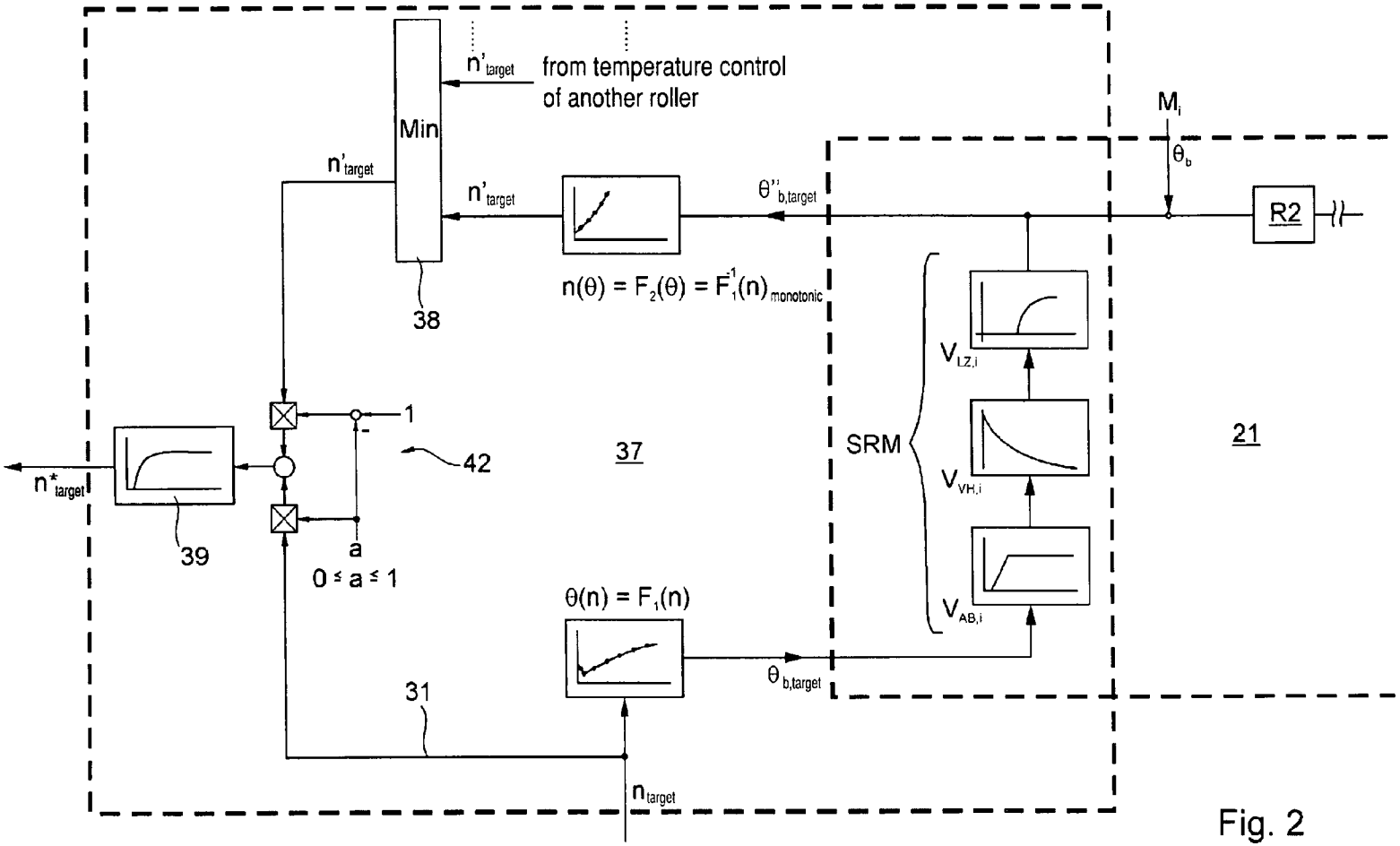
FIG. 2 a detailed representation of the control system for modifying a target value for rotational speed.

As is shown in greater detail in FIG. 2, a target value $\theta_{b,target}$ for the temperature, which represents the component temperature $\theta_b$ and which is to be controlled, is determined using the target value for rotational speed $n_{target}$ provided by the control level 31, by applying a first rule $F_1(n)$; and this target value $\theta_{b,target}$ is supplied to the control unit 21. The rule $F_1(n)$ is preferably stored. However, it can be modified, for example, by an interface or input option. The control unit 21 then acts according to its rules to achieve this target value $\theta_{b,target}$. First, regardless of where this occurs, to adjust the start-up to the dynamic response of temperature control, this target value $\theta_{b,target}$ is modified, taking into account the at least one element of the path and/or control model SRM. The resulting corrected target value $\theta''_{b,target}$ thus takes the influences and the behavior of the control path 02 into account, at least partially, but as precisely as possible. A precontrol element for running time, if applicable, with a time constant, $V_{LZ}$ and/or a derivative action element $V_{VH}$ and/or a precontrol relating to a control element characteristic by use of a velocity limiter $V_{AB}$ and/or a precontrol element relating to heat flow rate $V_{WF}$ can advantageously be taken into account. The latter element can be advantageously used when the measurement point $M_i$ lies outside of the component 01, such as, for example, is situated at a significant distance from the roller surface which is ultimately of interest. The listed elements are described in greater detail below, together with their action, in connection with diagrams of the control unit 21, and can be applied to the description of FIG. 1 and FIG. 2. Because the control unit 21 preferably has a path and/or has a control model SRM with one or more corresponding elements, in order to prevent oscillations in the control process itself, in an advantageous embodiment, the target value $\theta''_{b,target}$, which has been corrected with respect to the control path, is generated directly using the corresponding elements of the path and/or control model SRM of the control unit 21, and is taken from there. In FIG. 1 and FIG. 2, this fact is accounted for by showing the representation of the control unit 21 and a schematic representation of a memory and/or processing unit 37, or also a corresponding computing process 37 or memory and/or computing device 37 as intersecting one another. The memory and/or processing unit 37 need not be concretely embodied in the manner shown. It can instead be spatially embodied as being either entirely or partially within one of the control units 21, or as a program in a computer which displays the control processes. For operation or for start-up, it is highly advantageous for one and the same path and/or control model SRM to be used, both for the process of adjustment to the dynamic response of the temperature control device and for a control process of the temperature control device. This makes it unnecessary to determine and adjust parameters at two locations for two processes which are linked by the same temperature control device. It is also advantageous for the control process and for the process of adjustment to be based upon one and the same set of dynamics.

Based upon the target value $\theta''_{b,target}$, which is corrected with regard to the control path 02, a corrected target value for rotational speed $n'_{target}$ is then generated using a second rule $F_2(\theta)$. This second rule, in which $n'_{target}=F_2(\theta)$, preferably represents the inverse function, or the values reflected by the angle bisectors of the first quadrant, of the first rule $F^{-1}{}_1(n)$. If the memory and/or processing unit 37 is assigned only one temperature control unit 20, 21, this corrected target value for rotational speed $n'_{target}$, optionally after being fed again through a velocity limiter 39, could then be provided to the drive control 33 or the drives 32 as a modified target value for rotational speed $n^*_{target}$, optionally fed through the control level 31. In a variation, in which the memory and/or the processing unit 37 is assigned multiple temperature control devices 20, 21, and particularly is assigned at least a number of temperature control devices that corresponds to the number of printing couples assigned to one and the same web of print substrate such as, for example, eight printing courses, it is advantageous to first determine the minimum of the corrected target values for rotational speed $n'_{target}$ from all off the temperature control devices that are assigned to this memory and/or processing unit 37, shown as step 38 in FIG. 2, in order to then pass this on as an already modified target value for rotational speed $n^*_{target}$ for the purpose of controlling the drives 32, or to further process this through further modification to a modified target value for rotational speed $n^*_{target}$. Preferably, the temperature control devices for the respective comparable rollers 01 of all of the printing couples of a printing tower, or all of the printing couples which are assigned to the same web of print substrate such as, eight printing couples, for example, or the same printed sheet path, are processed using the same memory and/or processing unit 37. The determination of the minimum then relates to this number, such as eight of corrected target values for rotational speed $n'_{target}$.

In one advantageous embodiment, devices 42 are provided for use in "combining" the, if applicable minimized, corrected target values for rotational speed $n'_{target}$ with the target value for rotational speed $n_{target}$, as originally provided from the control level 31. This allows the responsivity of the memory and/or of the processing unit 37 to be adjusted. Using an adjustable factor "a", such as $0 \leqq$ "a" $\leqq 1$, the part of the originally provided target value for rotational speed $n_{target}$ and the part of the, if applicable minimized, corrected target values for rotational speed $n'_{target}$, which are to be taken into consideration in generating the modified target value for rotational speed $n^*_{target}$ can be adjusted. It has proven advantageous for the ratio of the corrected target value for rotational speed $n'_{target}$ to be at least 50%, wherein "a"<0.5, and particularly to be between 60% and 80%, for example, for the value "a" to lie between 0.2 and 0.4.

The procedure for first adjusting the target value for a rotational speed $n_{target}$ coming from the control level 31 in a memory and/or processing unit 37 or in corresponding processes in the memory and/or in the processing unit 37 to the set of dynamics, such as, for example, to the response time of the temperature control unit and then correspondingly modifying that target value, can be applied particularly advantageously in operating phases I that are transient in terms of press speed, such as, for example, during the aforementioned run-up phase and/or during a velocity change or during shut down. Although this procedure can also be applied during steady operating phases II, such as, for example, at a constant press speed "n", for example, at a production speed $n_P$ during the steady production phase, the target value for rotational speed $n_{target}$ originating from the control level 31 will then advantageously be either "looped" unmodified through the memory and/or processing unit 37, for example, or will be provided directly by the control level 31, without modification, to the drives 32 and/or the drive control 33.

Figure 9:
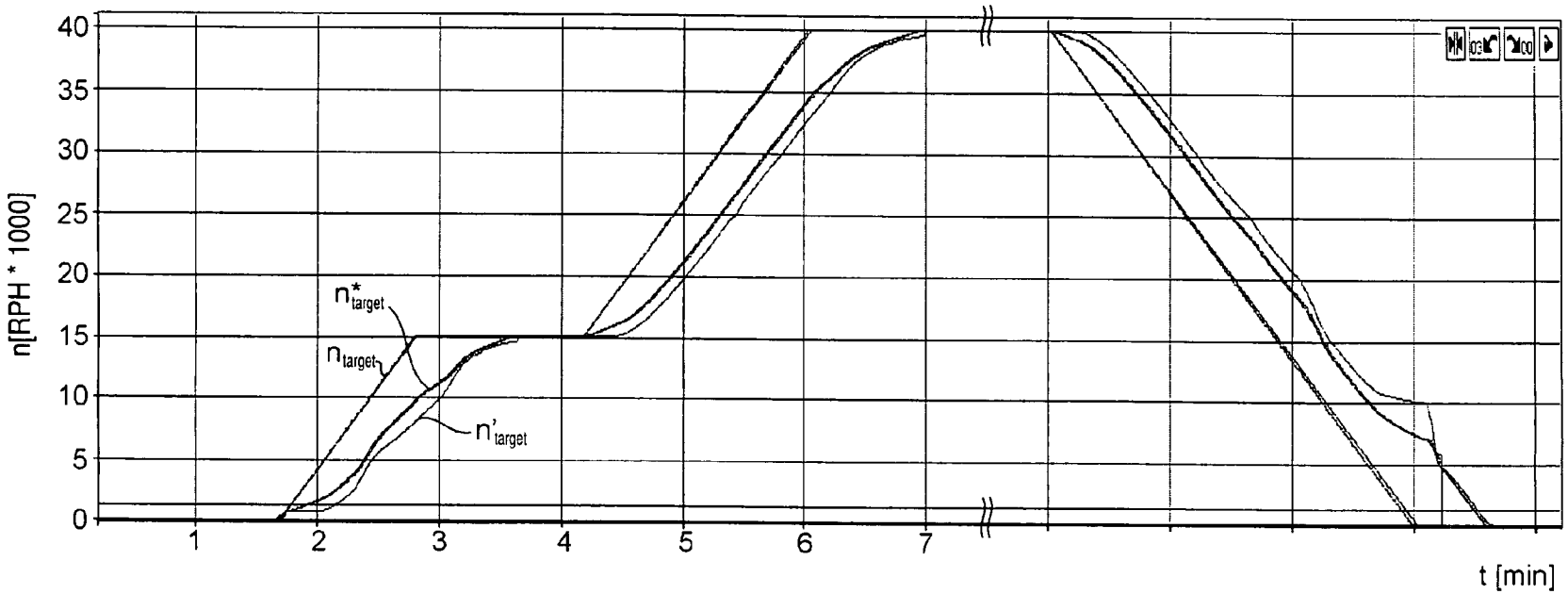
FIG. 9 a curve of a profile, over time, of the target values for rotational speed.

In FIG. 9, an example of a profile of the various aforementioned rotational speed values over time, and using the previously described procedure, during operation of the printing press, is schematically represented. The upper curve represents the target value for rotational speed $n_{target}$ provided by the control level 31. This speed or speed curve begins, for example, with a first slope, followed by a plateau, in which, for example, a print-on positioning of the cylinder is carried out, another upward slope, that represents acceleration to production speed n, maintenance of press speed "n" at the level of the production speed $n_P$, until shut down or the approach of the end of production, and deceleration of the press rotational speed n, along a falling slope. The lowest curve shows the minimized corrected target value for rotational speeds $n'_{target}$, which is generated as a minimum from multiple corrected values, in this case eight such corrected values. The apparent irregularities in the slopes result from the minimum being established at different times using corrected values for rollers alternatingly taken into account. As the diagram shows, at the beginning of the slope for the prescribed target value for rotational speed $n_{target}$, the corrected target value for rotational speed $n'_{target}$ does not rise with it. As the profile continues, the corrected value lags along behind the former value, at a different time, which ultimately is an expression of the response time of temperature control. The target value for rotational speed $n^*_{target}$, which has been modified by the factor "a" as a result of the aforementioned procedure, is shown as the center curve. This target value for rotational speed is then provided, for example, to the drive controller or is provided to the higher-level drive control 33 which generates the control level 31. As a result of the factor "a", after a start-up command has been entered by the operator, no temporary idle period occurs, as is the case with the lowest curve, rather the printing press is set in motion, although more slowly than is indicated by the slope. To a certain extent, the application of the factor "a" is "cosmetic" in nature, and can also be dispensed with in a simpler embodiment. In that case, the printing press will move as prescribed by the lowest curve.

In an advantageous embodiment of the present invention, the procedure, which has been described in relation to the press rotational speed "n", is to be applied to a parallel processing of acceleration values. This is carried out according to the same concept described for the press rotational speed "n".

In the event of a failure in the control unit 21 and/or the memory and/or processing unit 37 it can be provided that the original target value for rotational speed $n_{target}$ will be provided to the drives 32 or to the drive control 33.

In the event of a failure, the target value $n^*_{target}$, which was last transmitted from the memory and/or from the processing unit 37, can also advantageously be accepted as a new initial target value, in order to avoid any target value step changes that might possibly occur.

In principle, the previously described temperature control device 20 can be embodied differently and in such a way that energy, in the form of heat, can be introduced into the component 01 and/or can be removed from the component 01 in a targeted manner. In addition to the advantageous embodiment, which will be described in greater detail below, and involving the introduction of a temperature-controlled fluid, through a corresponding temperature control path 02, other possibilities are also conceivable. For example, these possibilities include the introduction of electrical energy into the component 01 and its conversion there into heat, or, for example, include temperature control, through a fan, the air from which fan is temperature controlled either directly through contact with electrically heated coils or indirectly via a heat exchanger.

What has been described thus far can be applied advantageously on its own. In the discussion which follows, the above-described method will be presented in an application with an advantageous special embodiment of the temperature control device 20 and an advantageous multi-loop control unit 21, all as seen in FIG. 3 and FIG. 4.

In the present example, a temperature control is implemented through the use of a temperature control medium, particularly a fluid, such as water, for example, which is placed in thermal interaction with the component 01 via a temperature control path 02. If the fluid is to flow over the component 01, the fluid can also be a gas or a gas mixture, such as air, for example. For use in temperature control, the fluid is supplied to the component 01 in a first circuit 03, flows through or flows around the component 01, absorbs heat, for cooling the component, or gives off heat, for heating the component, and then flows back, itself correspondingly heated or cooled. In this first circuit 03, a heating or cooling unit can be arranged, which can serve to generate the desired fluid temperature.

Figure 3:
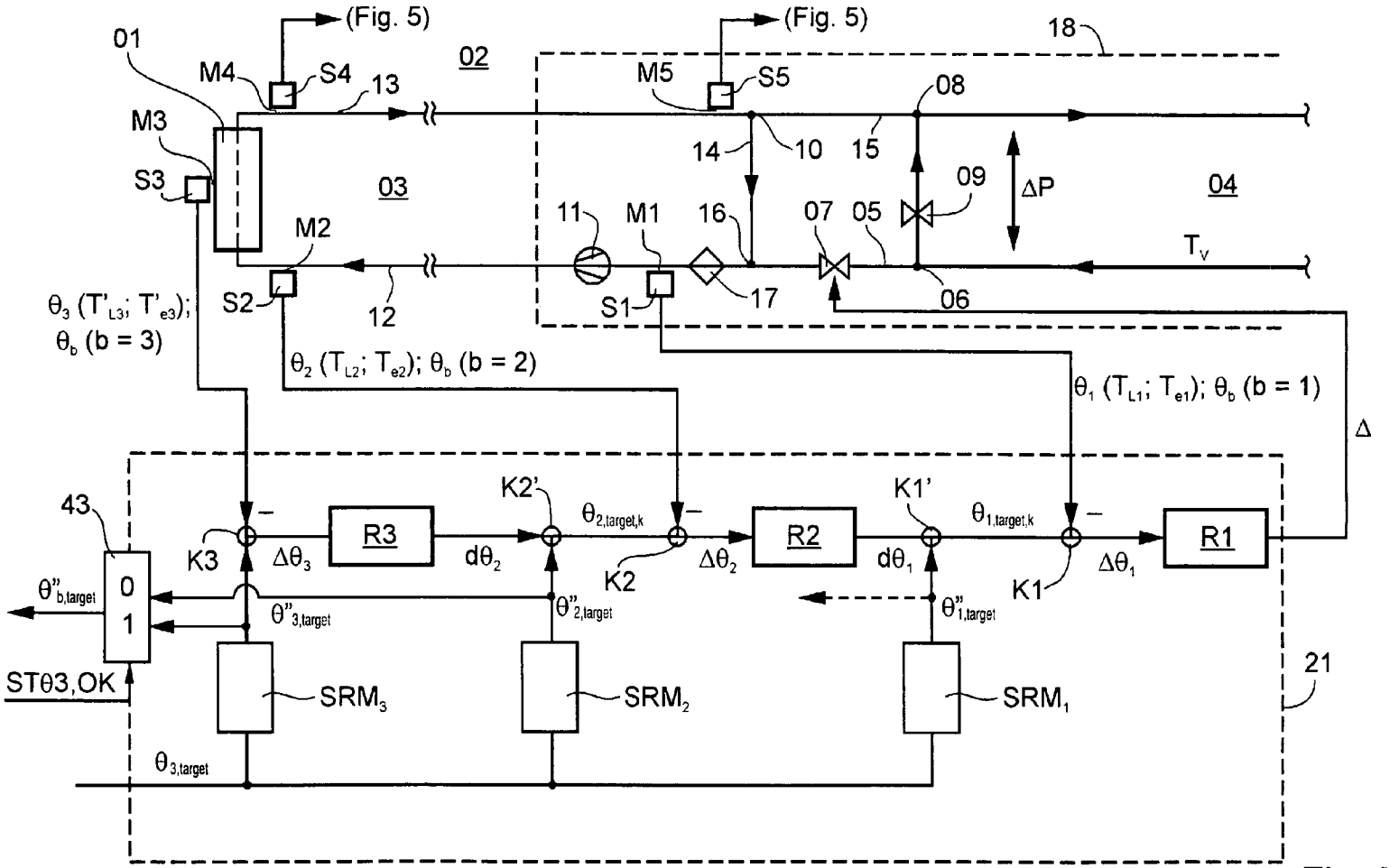
FIG. 3 a schematic representation of a temperature control path with a first preferred embodiment of the control unit or the control process.
Figure 4:
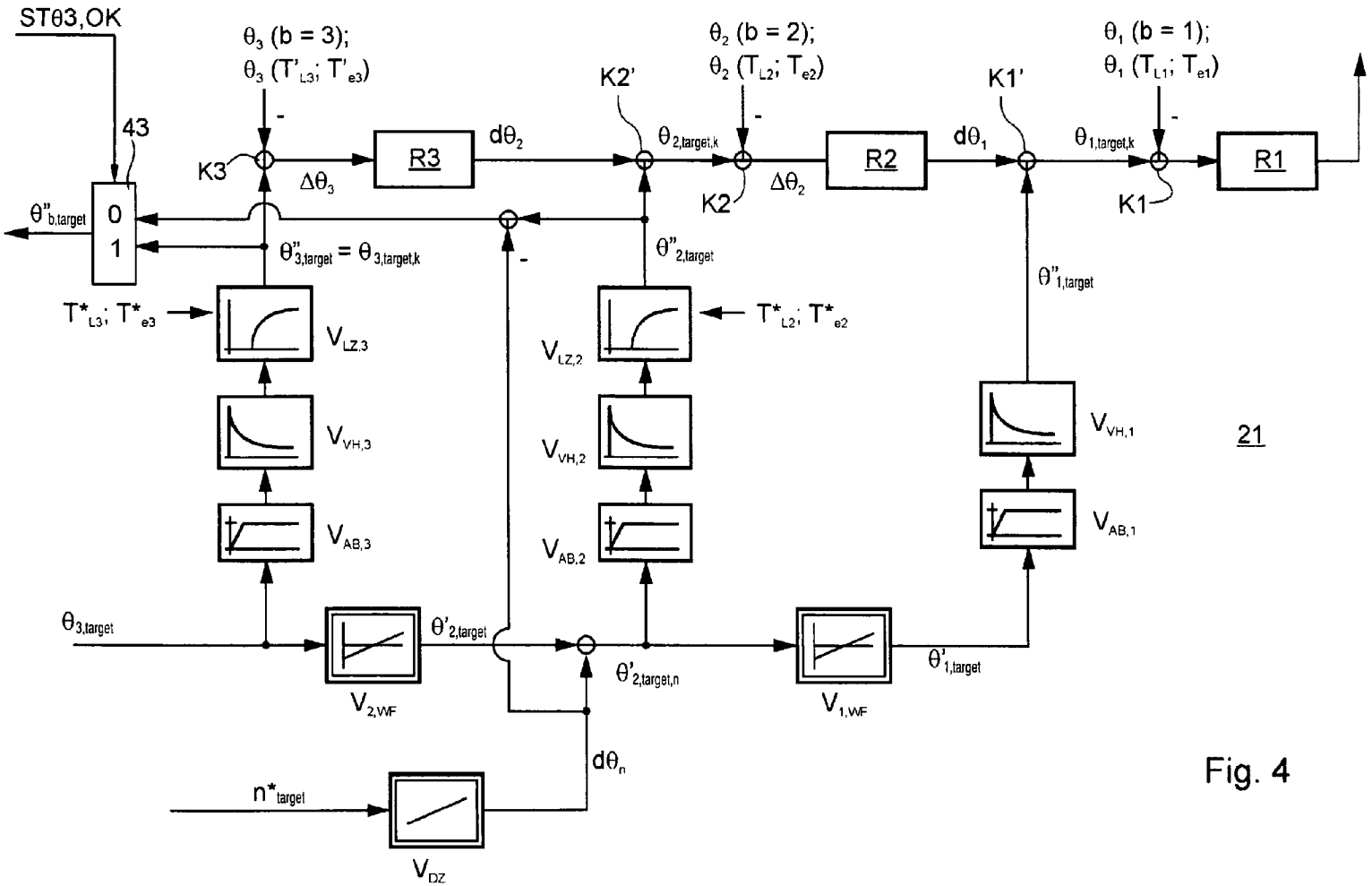
FIG. 4 a detailed depiction of a preferred embodiment of the control unit or of the control process.

In the advantageous embodiment of FIG. 3, however, the first circuit 03 is connected as a secondary circuit 03 to a second circuit 04, a primary circuit 04, in which the fluid is circulating at a defined and a largely constant temperature $T_V$, such as, for example, at an inlet temperature $T_V$. A temperature control device, such as a thermostat or a heating and/or a cooling unit and the like, for example, which ensures that the inlet temperature $T_V$ is maintained, is not represented in FIG. 3. Through a connection 05 between primary circuit 04 and the secondary circuit 03, fluid can be removed from the primary circuit 04 at a first connection point 06 of the primary circuit 04 via a control element 07, such as, for example, a controllable valve 07, and can be metered to the secondary circuit 03. At a second connection point 08, and based upon the intake of new fluid at the first connection point 06, fluid is returned from the secondary circuit 03, at a connection point 10 and through a connection 15, to the primary circuit 04. In this arrangement, for example, the fluid in the area of the first connection point 06 is at a higher pressure than it is in the area of the second connection point 08. A difference $\Delta P$ in the pressure levels is generated, for example, by the provision of a corresponding valve 09 between the connection points 06; 08.

The fluid, or a majority of the fluid, is circulated in the secondary circuit 03 along an inflow path 12, through the component 01, along a return flow path 13, and along a path segment 14 between the inflow path 12 and the return flow path 13 by the operation of a drive 11, such as, for example, by the operation of a pump 11, a turbine 11, or in some other way. Based upon the intake, controlled by the valve 07, a corresponding quantity of fluid, after passing through the component 01, flows out through the connection 15 into the primary circuit 04, or a correspondingly reduced quantity of fluid flows through the path segment 14. The portion that flows back through the path segment 14 and the part that has been freshly fed in through the valve 07 to the intake or to the injection point 16, mix together and then form the specifically temperature-controlled fluid for use in temperature control. To improve mixing, in an advantageous embodiment, a mixing path 17, and particularly a mixing chamber 17, is arranged as close as possible downstream of the injection point 16, and particularly is positioned between the injection point 16 and the pump 11.

In the above-described arrangement, but now in which temperature control is carried out, not by the use of a primary circuit 04, but instead by the use of a heating or cooling unit, the intake or injection point 16 corresponds to the point of energy exchange with the relevant heating or cooling unit. The control element 07 now corresponds, for example, to a power control or to the like, which is assigned to the heating or cooling unit. The connection point 10 in the secondary circuit 03 is dispensed with, because all the fluid is now circulated in the circuit 03, and energy is fed in or is removed and/or heat or cold is "fed in" at the intake point 16. In this arrangement, the heating or cooling unit corresponds to the control element 07, for example.

Through the temperature control process, ultimately a determined temperature $\theta_b$, in this case where b=3, or in other words the temperature $\theta_3$ of the component 01, in the case of a roller 01, and particularly the surface temperature $\theta_3$ of the roller 01, is to be adjusted to, or is to be maintained at a certain target value $\theta_{3,target}$. This is accomplished by measuring a representative temperature, on one hand, and by controlling the intake of fluid from the primary circuit 04 to the secondary circuit 03 for generating a corresponding combined temperature, on the other hand.

It is thus advantageous for at least two measurement points M1; M2; M3, each with a sensor, S1; S2; S3, respectively, to be provided in the present temperature control device 20 between the injection point 16 and an outlet of the component 01 that is to be temperature controlled. One of the measurement points M1 is located near the injection point 16. At least one of the measurement points M2; M3 is located in the area of the end of the inflow path 12 that is close to the component, and/or in the area of the component 01 itself. The valve 07, the pump 11, the injection point 16 and the connection points 06; 08 are ordinarily spatially close to one another and are arranged, for example, in a temperature control cabinet 18, which is indicated in FIG. 3 by a dashed line. Inflow path 12 and return flow path 13, between the component 01 and the outlet from or the inlet into the temperature control cabinet 18, and which are not explicitly represented in FIG. 3, are usually comparatively long in relation to the other paths. This relative length is indicated in FIG. 3 by breaks in the respective paths 12;13. The locations for measurement are chosen such that at least one measurement point M1 is located in the area of the temperature control cabinet 18 and one measurement point M2; M3 is located close to the component, or in other words at the end of the long inflow path 12.

In the preferred embodiment of FIG. 3, a measurement of a first temperature $\theta_1$ is carried out between the injection point 16 and the pump 11, and particularly is carried out between a mixing path 17 and the pump 11, by the use of a first sensor S1. A second temperature $\theta_2$ is determined by a second sensor S2 in the area of an intake into the component 01. The temperature $\theta_3$ is also determined in FIG. 3 by a measurement, and specifically by an infrared sensor, or IR sensor S3, which is directed toward the surface of the roller 01. The sensor S3 can also be arranged in the area of the cylinder surface, or under certain circumstances, as described below, can also be dispensed with.

Temperature control is carried out with the help of a temperature control unit 21 or a control process 21, which will be described in greater detail in what follows. Here, the temperature control unit 21, as seen in FIG. 3, is based upon a multi-loop, and in this case is based on a triple-loop, cascade-type control. An innermost control loop has the sensor S1 which is situated shortly downstream of the injection point 16, a first controller R1 and the control element 07, such as, for example, the valve 07. The controller R1 receives, as an input variable, a deviation $\Delta\theta_1$ ($\Delta\theta_i$, in this case with i=1) of the measured value $\theta_1$ from a corrected target value $\theta_{1,target,k}$ (node K1) and acts in accordance with its implemented control response and/or control algorithm on the control element 07 with a control command Δ. In other words, based upon the deviation of the measured value $\theta_1$ from the corrected target value $\theta_{1,target,k}$, the controller R1 opens or closes the valve 07, or maintains the current valve position. The corrected target value $\theta_{1,target,k}$ then is not provided directly through a control system or manually, as is otherwise customary, but is instead generated using an output variable from at least a second control loop that lies farther to the "outside."

The second control loop has a sensor S2 which is closer to the component, and preferably is shortly upstream of the intake into the component 01, or in a double-loop embodiment, which is not specifically shown, is assigned to the component 01, and a second controller R2. The controller R2 receives, as its input variable, a deviation $\Delta\theta_2$ of the measured value $\theta_2$ at the sensor S2 from a corrected target value $\theta_{2,target,k}$ (node K2), and generates, at its output, in accordance with its implemented control response and/or control algorithm, a variable $d\theta_1$ which correlates with the deviation $\Delta\theta_2$, output variable $d\theta_1$, and which is also used to generate the aforementioned corrected target value $\theta_{1,target,k}$ for the first controller R1. In other words, based upon the deviation of the measured value $\theta_2$ from the corrected target value $\theta_{2,target,k}$, the corrected target value $\theta_{1,target,k}$ to be generated for the first controller R1 is influenced by the variable $d\theta_1$, $d\theta_i$, in this case with i=1.

In the embodiment of the controller, which is preferred in connection with the previously described concept for adjusting the press rotational speed "n" to the dynamic response of temperature control, at least one target value $\theta_{b,target}$, in this case b=1, 2 or 3, for example, is used in the control process and is modified using at least one element of a path and/or of a control model $SRM_i$, in this case i=1, 2 or 3, of the temperature control device 20, 21, thereby taking into account influences on, and responses of the control path 02, at least to some extent. As stated above, the path and/or the control model $SRM_i$ can have one or more of the elements precontrol element for running time, if applicable, with a time constant $V_{LZ}$ and/or a derivative action element $V_{VH}$ and/or a precontrol relating to a control element characteristic by the provision of a velocity limiter $V_{AB}$ and/or a precontrol element relating to heat flow rate $V_{WF}$.

In the embodiment of the controller shown, the corrected target value $\theta_{1,target,k}$ (b=1) of the inner control loop for the first controller R1 is generated at a node K1', such as, for example, by addition or subtraction, from the variable $d\theta_1$ and a theoretical target value $\theta''_{1,target}$, $\theta''_{i,target}$, in this case with i=1, taking into account elements of a path and/or of a control model $SRM_i$.

In principle, a simpler embodiment of the control unit 21 is possible, in which simpler embodiment, only the first two stated control loops form the cascade-type control, or even in the simplest embodiment, only one of the two inner control loops or the outer control loop with its precontrol elements, forms the control unit 21. In this simpler embodiment, in the first case, the corrected target value $\theta''_{b,target}$ would be generated, for example, from the SRM of one of the two control loops, and preferably from the outermost control loop, and in the second case, it would be generated from the path model of the sole control loop. In principle, it is the case that, with single-loop control devices 21, one or more elements of the path and/or control model $SRM_i$ of this control loop, and with multi-loop control devices 21, one or more elements of the path and/or control model $SRM_i$ of one of the loops, but preferably of the outer loop, are used to generate the corrected target value $\theta''_{i,target}$ for further processing for adjustment to the dynamic response, or response time of temperature control. In the multi-loop case presented here, a switching device 43 can also be provided, by the use of which switching device 43, and based upon requirements, it can switch from the corrected target value $\theta''_{i,target}$ for one of the loops to the corrected target value $\theta''_{i,target}$ for a different loop. This can be advantageous, for example, when redundancy, with respect to the sensor system, is to be ensured, or in other words, for example, if the sensor at the measurement point M3 fails or becomes contaminated. In this case, the switching device 43 is preferably embodied as being electronically switchable, so that, using a switching circuit, if the functioning of the relevant sensor $S_i$, with i=1, 2, 3, fails or is faulty, this is detected, and the switching device 43 will be switched. In FIG. 4, this is indicated, by way of example, by a switching signal STθ3, OK, which, in this case, places the switching device 43 in the setting for transmitting the corrected target value $\theta''_{3,target}$ to the third loop.

In the embodiment which is shown in FIG. 3 and in FIG. 4, however, the temperature control unit 21 has three cascading control loops. The corrected target value $\theta_{2,target,k}$ upstream of the second controller R2 here also is not generated directly through a control system or manually, as is otherwise customary. Instead, it is generated using an output variable from a third, outer control loop. The third, outer control loop has the sensor S3, which detects the temperature on, or in the area of the outer surface of the roller, and also has a third controller R3. The third controller R3 receives, as an input variable, a deviation $\Delta\theta_3$ of the measured value $\theta_3$ at the sensor S3 from a target value $\theta_{3,target}$, or node K3, and generates, at its output, and according to its implemented control response and/or its control algorithm, a variable $d\theta_2$. This variable correlates with the deviation $\Delta\theta_3$, and is used to generate the previously discussed corrected target value $\theta_{2,target,k}$ for the second controller R2. In other words, based upon the deviation of the measured value $\theta_3$ from the target value $\theta_{3,target}$, or from a corrected target value $\theta''_{3,target}$, as discussed below, which is prescribed through a machine control system or manually, the corrected target value $\theta_{2,target,k}$ of the second controller R2, which is to be generated, is influenced by the variable $d\theta_2$.

The corrected target value $\theta_{2,target,k}$ for the second controller R2 is generated at a node K2', such as, for example, by addition, or subtraction, from the variable $d\theta_2$ and from a theoretical target value $\theta'_{2,target}$ (or $\theta''_{2,target}$, as discussed below. The theoretical target value $\theta'_{2,target}$ is again generated in a precontrol element relating to the heat flow rate $V_{2,WF}$. Here, the precontrol element $V_{2,WF}$ takes into account, for example, the heat and/or the cold losses on the path segments between the measurement points M2 and M3, by generating a correspondingly increased or decreased theoretical target value $\theta'_{2,target}$ which is then processed together with the variable $d\theta_2$, to obtain the corrected target value $\theta_{2,target,k}$ for the second controller R2.

The above described method of control is therefore based firstly upon the measurement of the temperature directly downstream of the injection point 16 and upon at least one additional measurement taken close to the component 01 that is to be temperature controlled. Secondly, a particularly short reaction time of the control system is achieved. Multiple control loops are interconnected in a cascading fashion. A measured value $\theta_2$; $\theta_3$, which is located closer to the component 01, is taken into account in the generation of the target value for the inner control loop. Thirdly, a particularly short reaction time is achieved through a precontrol, which introduces empirical values for projected losses along the temperature control path 02. Thus, a target value that is correspondingly increased or decreased by an empirical value is provided to a control loop which is located closer to the control element 07 and based upon projected losses.

In the depiction of FIG. 3, the elements for precontrolling each of the control loops are identified solely schematically, and are combined as $SMR_1$; $SMR_2$; $SMR_3$, respectively. One or more of the aforementioned elements can be included in this schematic element. In the discussion which follows, and which is based upon FIG. 4, the widest range of advantageous possibilities for configuring the precontrol will be presented.

In one embodiment, and in one or in more of the control loops, a path and/or a control model $SRM_i$, which is a precontrol element relating to heat flow rate $V_{WF}$ can be provided. The precontrol element $V_{WF}$, in this case $V_{i,WF}$, with the index i for the target value generation for the $i^{th}$ control loop, takes into account the heat exchange, such as losses and the like, of the fluid over a path segment and is based upon empirical values, such as expert knowledge, calibration measurements and the like. Thus, the precontrol element $V_{1,WF}$, with the index 1 for the target value generation of the first control loop, takes into account, for example, the heat or cold losses on the path segment between the measurement points M1 and M2 by generating a correspondingly increased or decreased theoretical target value $\theta'_{1,target}$, which is then processed, together with the variable $d\theta_1$, to generate the corrected target value $\theta_{1,target,k}$, for the first controller R1. In the precontrol element $V_{WF}$, a correlation between the input variable, such as the target value $\theta_{3,target}$ or $\theta'_{2,target}$ or $\theta'_{2,target,n}$, as will be discussed below, and a corrected output variable, such as the modified target value $\theta'_{2,target}$ or $\theta'_{2,target,n}$, or $\theta'_{1,target,n}$, also as will be discussed below, is established, and can preferably be modified, as needed, based upon parameters or in some other way. In the outer control loop, or in the control loop having the measured value that lies closest to the component 01, a precontrol element relating to heat flow rate $V_{WF}$ can also be provided. In the present example, however, downstream of the measurement point M3 no further appreciable heat or cold loss occurs. Thus, the path and/or the control model $SRM_i$, which is used to generate the corrected target value $\theta''_{b,target}$ to be processed in the memory and/or in the processing unit 37 can, but need not necessarily, have a corresponding precontrol element $V_{i,WF}$.

In addition to, or in place of the precontrol element or elements relating to heat flow rate $V_{1,WF}$; $V_{2,WF}$, the control unit 21 can have additional or different elements for precontrol.

As is apparent from FIG. 3, the fluid requires a finite running time $T_{L2}$, for example, for the path from the valve 07 to the sensor S2. In addition, the respective mixed temperature does not change instantaneously to the desired value with adjustment of the control element 07 due, for example, to response time of the valve, and heating or cooling of the pipe walls and pump, but instead is subject to a time constant $T_{e2}$. If this is not taken into consideration, severe overshoots can occur in the control process. For example, if a command to open the valve 07 is issued. However, the result of this improper opening, namely corresponding to hotter or colder fluid, will not yet have arrived at the measurement location of the measurement point M2. The corresponding control loop thus continues to incorrectly issue additional control commands to further open the valve. The same is true for the path from the valve 07 to the location of the detection of the temperature by use of the sensor S3, with the running time $T'_{L3}$ and a time constant $T'_{e3}$. In this case, the dashed reference symbol indicates that this involves not the time to the detection of the fluid temperature in the area of the roller shell, but to the time to detection of the temperature of the surface of the roller or the roller shell.

Based upon the delay, which corresponds to running time $T_{L2}$ or $T'_{L3}$, and the time constants $T_{e2}$ or $T'_{e3}$, the path reactions to the activities of the innermost controller R1 are, at first, not apparent at the level of the two outer controllers R2; R3. To prevent or at least to impede an otherwise resulting double reaction of these controllers, which would be an erroneous overreaction that could not be withdrawn, a precontrol element relating to running time and/or time constants $V_{LZ}$ is preferably provided as a path model element for the generation of the target value in one or more of the control loops. By the use of this precontrol element, the projected natural "delay", resulting from a change in the control element 07, is taken into consideration. Because of the precontrol element relating to running time and/or time constants $V_{LZ}$, the running time actually required by the fluid, which is determined based upon empirical values or preferably by recording measured values or through computer estimation, is simulated in the control system. The outer controllers R2; R3 then react only to those deviations that are not to be expected, based upon the modeled path properties, and thus are only those deviations that actually require correction. As a result of this symmetry, the outer controllers R2; R3 are made "blind" to the control deviations that are otherwise to be expected, which control deviations are physically unavoidable, and which are already being handled "locally" by the innermost controller R1. The "precontrol element" $V_{LZ}$ thus acts in the manner of a "running time and delay element" $V_{LZ}$. In the precontrol element $V_{LZ}$, the described dynamic property of running time and delay is represented and established, but can preferably be modified as needed based upon parameters or in some other way. For this purpose, corresponding parameters $T^*_{L2}$; $T^*_{e2}$; $T^*_{L3}$; $T^*_{e3}$, which are to depict and which represent the current running time $T_{L2}$ or $T'_{L3}$ and/or the equivalent time constant $T_{e2}$ or $T_{e3}$, for example, can be adjusted in the precontrol element $V_{LZ}$. The adjustment is to be carried out such that with it, a computer-generated, virtual dynamic target value profile, such as, for example, a target value $\theta''_{2,target}$ or $\theta''_{3,target}$, is compared, essentially synchronously, with the corresponding profile of the measured value $\theta_2$ or $\theta_3$, respectively, for the temperature at the assigned sensor S2 or S3, respectively, at the node K2 or K3, respectively.

For the outer control loop, the virtual, modified target value $\theta''_{3,target}$ corresponds with the target value $\theta''_{3,target,k}$, which is to be compared with the measured value, because it is not corrected by an additional control loop. Additionally, in the preferred embodiment, no precontrol element $V_{LZ}$ is provided for the innermost control loop, which has very short paths or running time. In a standardization of the nomenclature, the target value $\theta'_{3,target}$, without further modification, represents the target value $\theta''_{3,target}$.

A precontrol element $V_{LZ}$ of this type, which represents the path model, is advantageously provided at least in the path and/or in the control model $SRM_i$ for use in generating the target value of the control loop or control loops which are assigned to the sensor S2 close to the component or which are assigned to the sensors S2; S3 that are located close to the component. In the example, the two outer control loops have a precontrol element $V_{LZ,2}$; $V_{LZ,3}$ of this type in their target value generation. Should the path between the valve 07 and the sensor S1 be found to be too long and disruptive, it is also possible to provide a corresponding precontrol element $V_{LZ,1}$ for target value generation for the inner control loop. Thus, the path and/or the control model $SRM_i$ which is used to generate the corrected target value $\theta''_{b,target}$, which is to be processed in the memory and/or processing unit 37, also advantageously has a corresponding precontrol element $V_{LZ,i}$.

The control dynamics can also be improved, in a further development of the above-described control unit 21, if the conversion of the desired target value profile, at the level of the innermost control loop, is made faster and its following error is decreased by the use of a derivative action element $V_{VH,i}$ in the form of a time constant exchanger, such as, for example, $1^{st}$ order, typically, a lead/lag filter. This precontrol, in the form of the derivative action element $V_{VH}$, first effects an amplitude gain or overcompensation in the reaction, in order to accelerate the control process in a respective start-up phase, and then returns to neutrality.

To rule out any stability problems, this measure is preferably carried out only in the target value part that is not influenced by actual values, typically upstream of the respective nodes K1'; K2', which are an addition or subtraction point, or the like, depending upon the sign. To maintain balance in the outer controllers R2; R3, this dynamic measure must then also be compensated for by the use of corresponding derivative action elements $V_{VH,2}$ or $V_{VH,3}$ in the control loops that lie farther toward the outside, and which, if applicable, also act upon one or all of the described precontrols $V_{WF}$ relating to heat flow rate or $V_{LZ}$ relating to running time and/or time constants in the generation of the target value of the subsequent control loop.

In the precontrol element $V_{VH,I}$, the profile property of the described gain, relative to the input signal is represented and is established, but can be modified in terms, of level and profile, as needed, preferably based upon parameters or in some other way. According to the physical sequence, the derivative action element $V_{VH,i}$ is preferably arranged upstream of the precontrol element $V_{LZ}$, if it is present, and downstream of the precontrol element $V_{WF}$, if it is present, in relation to the signal path. The precontrol element $V_{VH}$ can also be used, in one of the embodiments according to FIG. 1 through FIG. 4, regardless of whether the precontrol elements $V_{LZ}$, $V_{DZ}$, or $V_{AB}$, as will be discussed below, are provided, or in addition to these.

If a precontrol element $V_{VH,i}$ is provided for accelerating the control process, the path and/or the control model $SRM_i$ which is used to generate the corrected target value $\theta''_{b,target}$ that is to be processed in the memory and/or processing unit 37 should also have a corresponding precontrol element $V_{VH,i}$.

The control dynamics can be improved in a further development in accordance with the present invention if, in addition to the precontrols or in addition to one of the described precontrols $V_{WF}$ relating to heat flow rate, running time and/or time constants $V_{LZ}$, and/or the derivative action element $V_{VH}$, a precontrol relating to rotational speed $V_{DZ}$ is also carried out, for example. Based upon a press rotational speed "n", more or less frictional heat is produced in a printing couple. If the mass flow of the fluid is to be maintained essentially constant, increased frictional heat can be produced only by decreasing the temperature of the fluid, and vice versa. The above-described control unit 21 would doubtless react, over time, to the change in frictional heat resulting from a decrease or an increase in the fluid temperature, but would react only if the temperature at the sensor S3 displays the undesirable temperature.

To further increase the dynamic response of the control unit 21, particularly under changing operating conditions, such as would occur in a run-up phase, a rotational speed change, and the like, the precontrol element relating to rotational speed $V_{DZ}$ is provided, which, in principle, can be superimposed over all subordinate target value determinations, such as, the generation of the target values $\theta''_{1,target}$, $\theta''_{2,target}$, $\theta''_{3,target}$, giving them the character of correcting variables. However, such superimposition of the outer control loop makes no sense if the measured value of the sensor S3 represents the technologically last valid actual value, such as, for example, the temperature of the effective area, for instance, the roller surface itself. Thus, in the preferred embodiment, the precontrol element $V_{DZ}$ acts only on the generation of target values $\theta''_{1,target}$ and $\theta''_{2,target}$, specifically so that a correction value $d\theta n$ is superimposed over the theoretical target value $\theta'_{2,target}$ which is generated by the precontrol element $V_{2,WF}$ which is upstream of the second control loop. The resulting target value $\theta'_{2,target,n}$ is used directly, or by corresponding precontrol elements $V_{VH,i}$ and/or $V_{LZ,i}$, to generate the target value of the second control loop (R2) and at the same time, by the precontrol element $V_{WF,i}$ and, if applicable, the precontrol element $V_{VH,i}$, to generate the target value of the first control loop (R1). In the precontrol element $V_{DZ}$, a correlation between the press rotational speed "n" and a suitable correction is established, which can preferably be modified, as needed, based upon parameters or in some other way. The modified target value for rotational speed $n^*_{target}$, which is generated by the memory and/or processing unit 37, is preferably supplied to the precontrol element $V_{DZ}$. The precontrol element $V_{DZ}$ can be applied independently of the presence of the precontrol elements $V_{LZ}$; $V_{VH}$, as will be discussed below, or $V_{AB}$, as also discussed below, or in addition to one or more of these.

However, if the sensor S3 measures not the outer surface, but a temperature that lies farther toward the interior of the component, which is not the last valid temperature in terms of the process, it can also make sense to allow the precontrol element $V_{DZ}$ to also act on the outer control loop (R3). The same applies to an outer control loop which obtains the measured value not directly from the component 01, but from a sensor S4; S5, which is arranged downstream of the passage through component 01, see FIG. 1 and FIG. 5, under certain circumstances linked to the measured value from S2.

If the control loop, whose path and/or whose control model $SRM_i$ is used to generate the corrected target value $\theta''_{b,target}$ to be processed in the memory and/or processing unit 37, is positioned upstream of a corresponding precontrol element $V_{DZ}$, in FIG. 4 the inner and center control loops, for example, then to avoid feedback coupling, the correction value $d\theta_n$ should be subtracted from the corrected target value $\theta''_{b,target}$ which contains the rotational speed correction, before being used in the memory and/or in the processing unit 37.

In FIG. 4, in a further development, upstream of the node K1 for generating the corrected target value $\theta_{1,target,k}$, optionally directly, an additional precontrol element $V_{AB,i}$ is provided as a dynamic model element, such as, for example, a velocity limiter $V_{AB,i}$, particularly non-linear. This element senses the ultimate correction time, which is not equal to zero, and the actual limitation of the control element 07 with respect to its maximum adjustment path, such as, for example, that even when a very significant change is required, only a limited opening of the valve 07 and thus a limited quantity of temperature-controlled fluid can be supplied from the primary circuit 04. In the precontrol element $V_{AB}$, the described velocity limitation, or valve property is represented and is established, but can preferably be modified as needed based upon parameters, or in some other way. The precontrol element $V_{AB}$ can be used independently of the presence of the precontrol elements $V_{LZ,i}$, $V_{VH,i}$, or $V_{DZ}$, or can be used in addition to these. However, if a precontrol element $V_{AB}$ of this type is provided upstream of the innermost control loop, this should also be provided in the control loops that lie farther toward the outside. In an advantageous embodiment of the present invention, the path and/or the control model $SRM_i$ which is used to generate the corrected target value $\theta''_{b,target}$ that is to be processed in the memory and/or in the processing unit 37, thus has a corresponding precontrol element $V_{AB,i}$.

Figure 5:
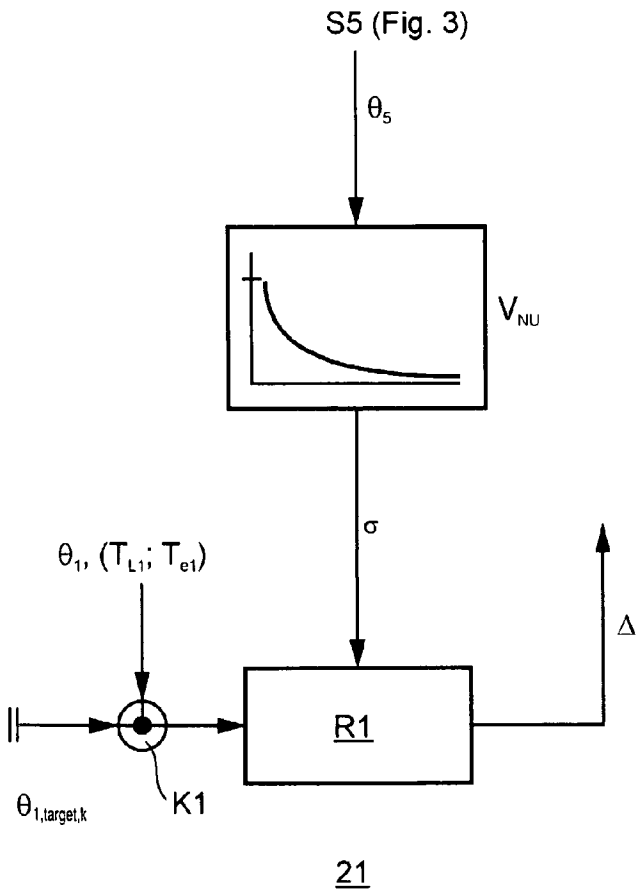
FIG. 5 a depiction of a further development of the preferred embodiment according to FIG. 3 and FIG. 4, and referring to the inner control loop.

FIG. 5 shows another further development of the embodiments of the first or innermost control loop, as has been described thus far. A measured value $\theta_5$ from a sensor S5 is recorded near, or in the area of the path segment 14, such as, for example, at a short distance from the injection point 16, and is used additionally for control purposes in the innermost control loop. In this case, the measured value $\theta_5$ is fed, as an input value, to an additional precontrol element $V_{NU}$ for dynamic zero suppression. The measured value $\theta_5$ provides information about the temperature at which the returning fluid will be available for the planned mixture with the supplied cooling or heating fluid. If the measured value $\theta_5$ should suddenly change significantly, such as, for example, if the temperature should drop off significantly, then the precontrol element $V_{NU}$ will generate a correspondingly opposite signal $\sigma$, for example, a significant increase in the opening at the valve 07, and this signal will be supplied to the controller R1. In this manner, the precontrol element $V_{NU}$ effects a counteraction of a change which is shortly to be expected at the sensor S1, even before this change has occurred there. Ideally, this feed forward control will prevent the change from occurring there.

The functional profile and the gain of the precontrol element $V_{NU}$ for this return flow temperature precontrol are established, and can preferably be modified, based upon parameters.

Figure 6:
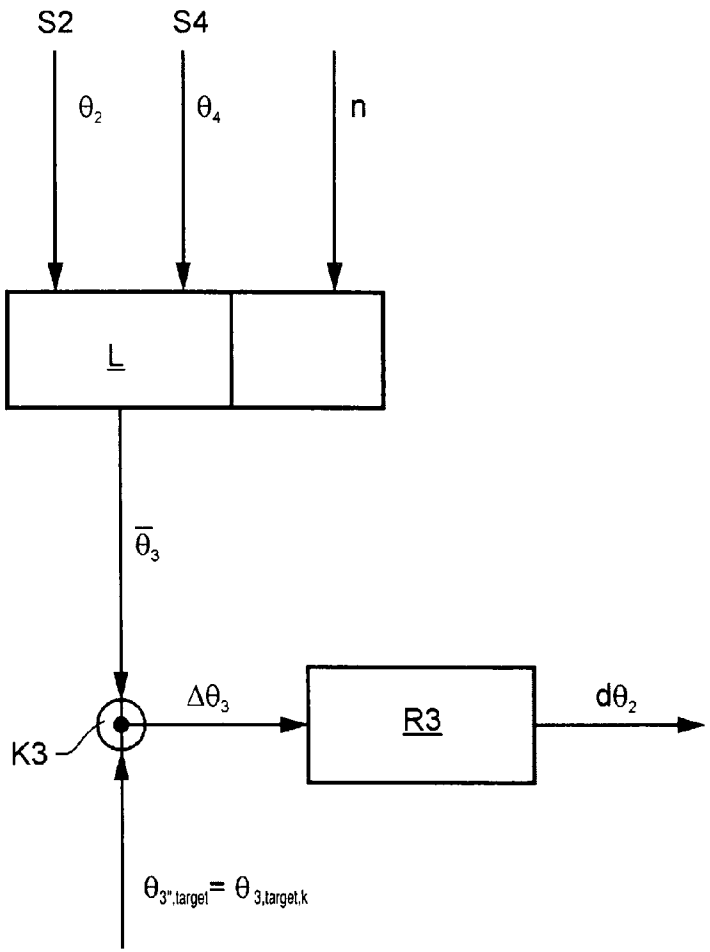
FIG. 6 a depiction of yet a further development of the preferred embodiment according to FIG. 3 and FIG. 4, and now referring to the outer control loop.

FIG. 6 shows a further development of the previous embodiments of the outer control loop. In contrast to the previous embodiments, for the outer control loop of the controller R3, the measured values $\theta_2$ and $\theta_4$ from sensors S2 and S4, which are positioned close to the component, rather than a measured value $\theta_b=\theta_3$ from a sensor S3 that detects the surface of the component, or that is located in its outer surface, are used in the inflow and return flow path 12; 13. These values are processed, together with a rotational speed signal for the press rotational speed "n" in a logic unit L or in a logic process L, on the basis of an established, but preferably a modifiable algorithm, to arrive at an equivalent measured value $\overline{\theta}_3$, such as, for example, the equivalent temperature $\theta_b=\overline{\theta}_3$ of the component 01, or the temperature of its surface. This equivalent measured value $\overline{\theta}_3$ is passed on, as a measured value or temperature $\overline{\theta}_3$, in place of the measured value $\theta_3$ in accordance with the previously discussed, preferred embodiments downstream of the node K3.

The controllers R1; R2; R3 from the preferred embodiments according to FIG. 3 and FIG. 4 are embodied in a simple variant as PI controllers R1; R2; R3.

Figure 7:
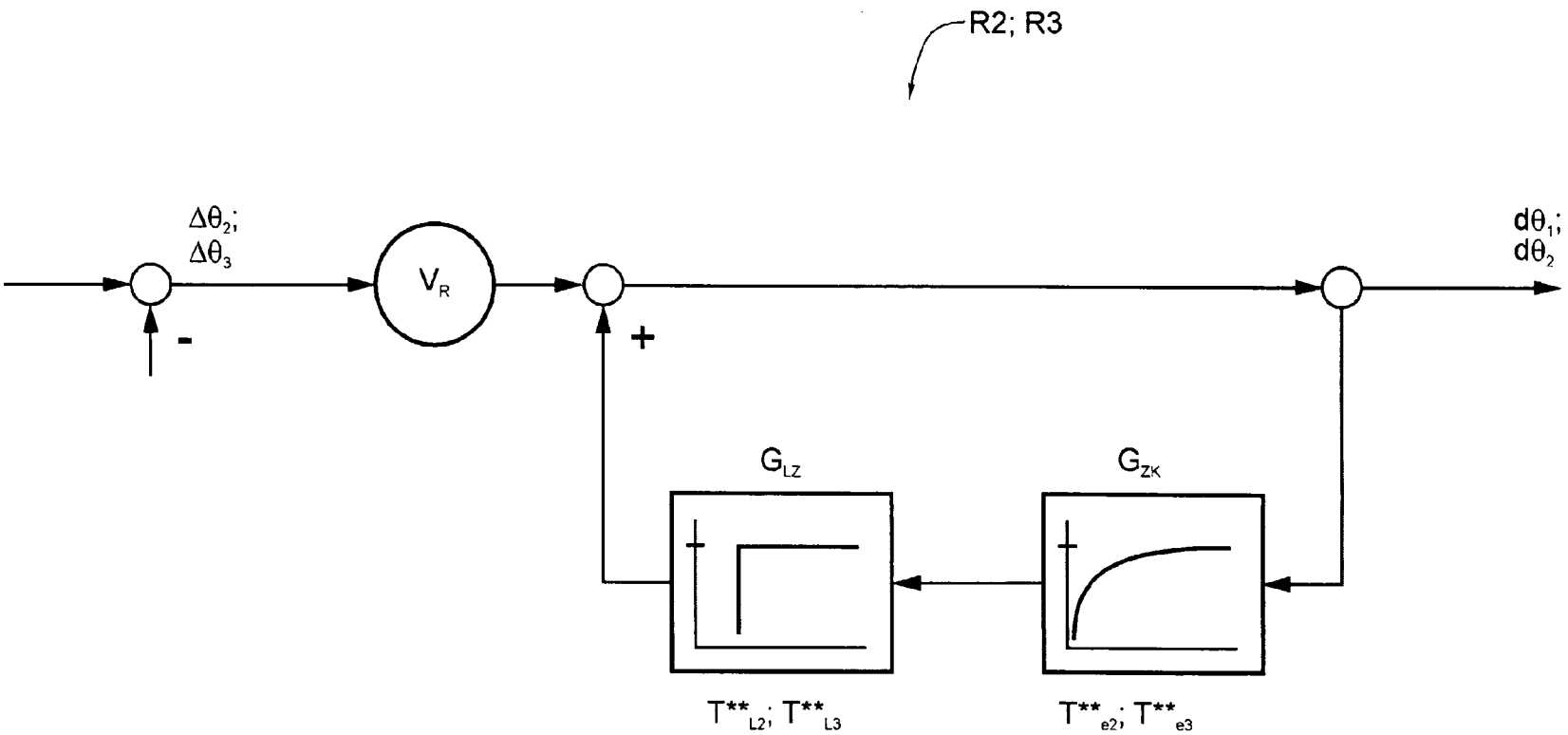
FIG. 7 a schematic representation of a controller based on running time.

In an advantageous embodiment, however, at least controllers R2 and R3 are embodied as so-called "running time-based controllers" or "Smith controllers." The running time-based controllers R2 and R3, and particularly the running time-based PI controllers R2 and R3, are represented, and are assigned parameters in FIG. 7 as an equivalent network diagram. The controller R2; R3 has the deviation $\Delta\theta_2$; $\Delta\theta_3$ as an input variable. It is embodied as a PI controller R2; R3 with a parameterizable gain factor $V_R$, whose output signal is fed back through an equivalent time constant element $G_{ZK}$ and a running time element $G_{LZ}$ or, as represented with the precontrol element $V_{LZ}$, as an element.

In the running time-based PI controller R2; R3, the running time or the delay time of the control path and its time constant, are represented and are established, but can preferably be modified, as needed, based upon parameters or in some other way. For this purpose, corresponding parameters $T^{}_{L2}$, $T^{}_{e2}$; $T^{}_{L3}$, $T^{}_{e3}$, which are intended, for example, to represent the actual running time $T_{L2}$ or $T_{L3}$ and/or the time constant $T_{e2}$ or $T_{e3}$, can be adjusted in the running time-based PI controllers R2 and R3. The values of the parameters $T^{}_{L2}$; $T^{}_{e2}$; $T^{}_{L3}$; $T^{}_{e3}$ and the values of the parameters $T^{*}_{L2}$; $T^{*}_{e2}$; $T^{*}_{L3}$; $T^{*}_{e3}$ from the precontrol elements $V_{LZ,i}$, and relating to running time and time constants, should essentially coincide with one another in the proper adjustment and rendering of the control path, since these describe the corresponding control path both in the controller R2; R3 and in the precontrol element $V_{LZ}$. Thus, if both running time-based PI controllers R2 and R3 and precontrol elements $V_{LZ,i}$ are used in the control unit 21, the same sets of parameters, determined at one time, can be used for both.

Figure 8:
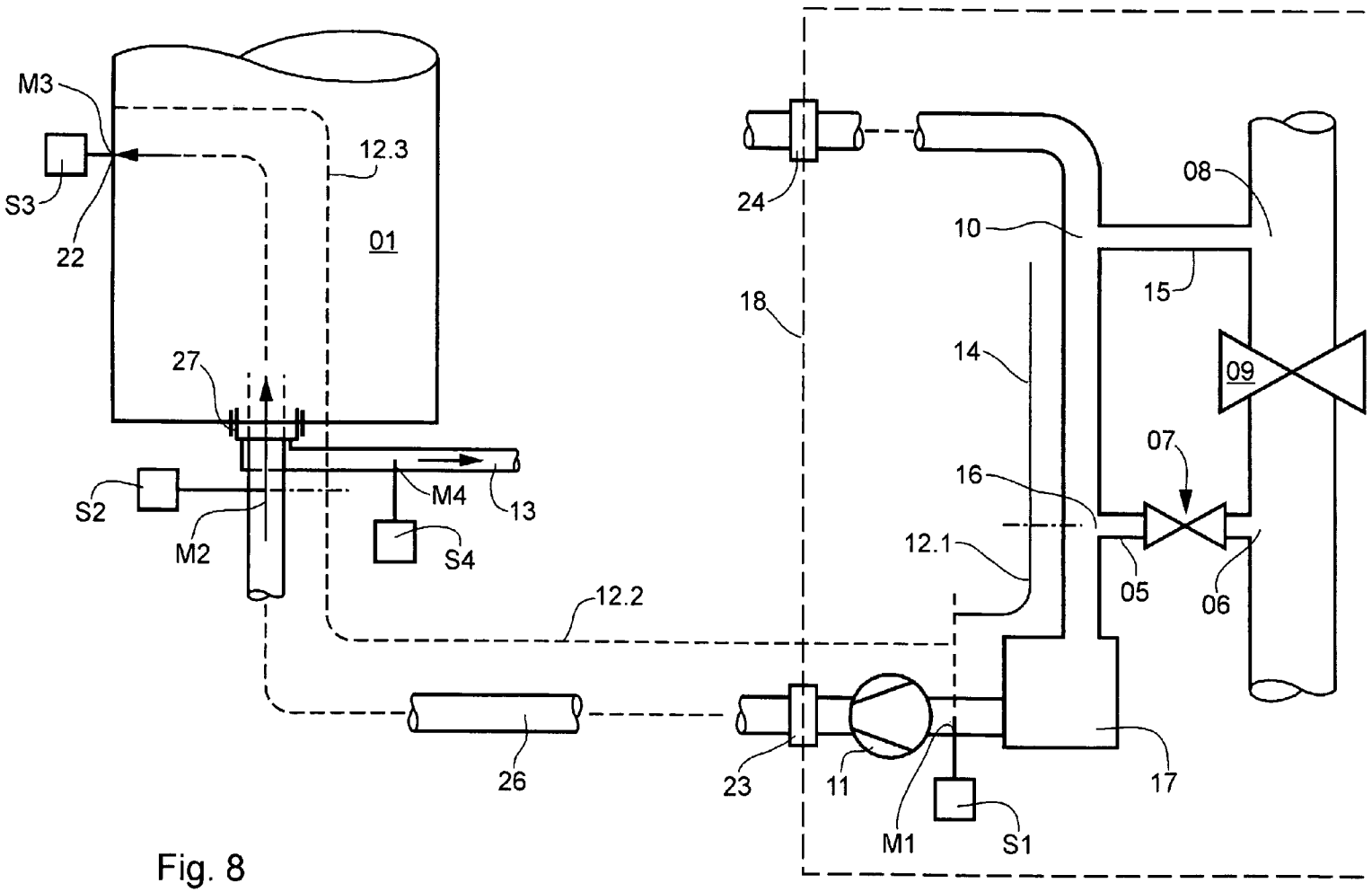
FIG. 8 a detailed section view of the temperature control path represented schematically in FIG. 3.

FIG. 8 shows a section of the temperature control path, which is represented schematically in FIG. 3, in an advantageous concrete embodiment. The inflow path, generally at 12, from the injection point 16 to a target location 22, such as, for example, to the location of the area or surface to be cooled, is represented in FIG. 8 in three sections 12.1; 12.2; 12.3.

The first section 12.1 of the inflow path, generally at 12, extends from the injection point 16 up to the first measurement point M1 with the first sensor S1. It has a first path length X1 and a first average running time $T_{L1}$. The second section 12.2 extends from the first measurement point M1 up to a measurement point M2, which is situated close to the component, and with the sensor S2. It has a second path length X2 and a second average running time $T_{L2}$. The third section 12.3, with a third path length X3 and with a third average running time $T_{L3}$ for the fluid, is connected to the second measurement point M2 and extends up to the target location 22, which, in this case, is the first contact of the fluid in the area of the extended outer surface. A total running time T for the fluid from the injection point 16 up to the target location thus results from the sum of $T_{L1}+T_{L2}+T_{L3}$.

The first measurement point M1 is chosen to be close to the intake point, and thus is a short distance from the intake point 16, which, in this case, is the injection point 16. Thus, the measurement point M1, which is close to the intake point, or the sensor S1, which is close to the control, is understood as a location in the area of the inflow path 12, which, in relation to the running time of the fluid $T_L$, lies less than one-tenth, and particularly is situated less than one-twentieth, of the distance from the intake point 16 to the point of first contact with the target point 22, which in this case, is the first contact of the fluid in the area of the extended outer surface, such that $T_{L1}<0.1$ T, and particularly such that $T_{L1}<0.05$ T. To achieve a high control dynamic response, the measurement point M1, with respect to the running time of the fluid $T_{L1}$, lies spaced a maximum of 2 seconds, and particularly is spaced a maximum of 1 second, from the injection point 16. As was already described in relation to FIG. 1, injection point 16, sensor S1 and the downstream pump 11 are located in a temperature control cabinet 18, which forms a structural unit of the assemblies contained therein. The measurement point M1 preferably lies upstream of the pump 11. The temperature control cabinet 18 can be connected to the component 01 via separable connections 23; 24 in the inflow path 12 and in the return flow path 13.

Ordinarily, component 01 and temperature control cabinet 18 are not arranged directly adjoining one another in the printing press, so that a line 26, such as, for example, pipework 26 or a hose 26, extends from the temperature control cabinet 18 to an intake 27 into the component 01, for example to a lead-in 27, and particularly to a rotating lead-in 27, and is of a corresponding length. The lead-in into the roller 01 or into the cylinder 01 is illustrated only schematically in FIG. 8. If the roller 01 or the cylinder 01 has a journal at its end surface, as is customary, the lead-in is through the journal. The path of the fluid to the outer surface of the component, and once in the component 01, along its outer surface, is represented only symbolically. Such a fluid path can extend below the outer surface of the component 01 in a known manner, such as, for example, in axial or spiral channels, in extended hollow spaces, in an annular cross-section, or in another suitable manner. The second measurement point M2 is chosen to be close to the component, and typically is situated a short distance from the component 01 or from the target location 22, which, in this case, is the roller surface. Thus, the second measurement point M2 close to the component or the second sensor S2 close to the component is understood here as a point in the area of the inflow path 12, which, in terms of the running time of the fluid, lies farther than half the distance from the injection point 16 to the point of first contact of the target point 22, which, in this case, is the point of first contact of the fluid in the area of the extended roller surface. In this case, $T_{L2}>0.5$ T. To obtain a high dynamic response of the control system, while keeping the structural complexity of the rotating components 01 low, the second measurement point M2 is arranged stationary in the area of the line 26, outside of the rotating component 01, but lies directly spaced, with respect to the running time of the fluid, at a maximum of 3 seconds from the intake 27 into the component 01.

The third measurement point M3, if provided, is also arranged at least close to the component, but particularly is located close to the target point. In other words, it is located in the immediate vicinity of the target point 22 of the fluid, or it detects directly the surface which is to be temperature controlled, which in this case, is the outer surface of the roller 01. In an advantageous embodiment, the measurement point M3 does not detect the fluid temperature, as is the case, for example, with measurement points M1 and M2. Instead, it detects the area of the component which is itself to be temperature controlled. The immediate vicinity of the target location 22 is understood here to mean that the sensor S3 is located between the fluid circulating in the component 01 and the outer surface, or that it detects the temperature $\theta_3$ on the outer surface of the component 01 in a contactless manner.

In another embodiment of the temperature control device, the measurement point M3 can be dispensed with. Conclusions regarding the temperature $\theta_3$ can be drawn from empirical values through the measured values from the measurement point M2, for example, and based upon a stored correlation, an offset, or a functional correlation. For a desired temperature $\theta_3$, for example, and taking into account the press or production parameters, including press rotational speed, surrounding temperature and/or fluid throughput, a blade friction coefficient, and heat flow resistance, a desired temperature $\theta_2$ is then regulated as the target value. In this case, this must be taken into account in determining the rules $F_1(n)$ and/or $F_2(\theta)$, since the temperature $\theta_2$ represents not the actual surface temperature of the component 01, but ultimately an equivalent temperature. The described rules must then be determined or established under these preconditions. However, the rules $F_1(n)$ and/or $F_2(\theta)$ are ultimately to be adjusted to the local conditions of the measurement value source, based upon the conditions, at every location where the actual value which is to be controlled does not relate to the roller surface or the ink on the roller itself, and instead lies a distance from this, either upstream or downstream, in the control loop. This adjustment can also be advantageous for the aforementioned averaged equivalent measured value $\overline{\theta}_3$.

In a further embodiment of the present invention, the measurement point M3 is again dispensed with. However, conclusions regarding the temperature $\theta_3$ are drawn from empirical values using the measured values from measurement point M2 and measurement point M4, for example, again based upon, for example, a stored correlation, an offset, a functional correlation and/or by determining the average of the two measured values. For a desired temperature $\theta_3$, for example, either a desired temperature $\theta_2$ is again regulated as the target value, taking into account the press or production parameters, including press rotational speed, surrounding temperature and/or fluid through rate, or the temperature $\theta_3$, which is determined indirectly based upon the two measured values, is regulated. In FIG. 8, the inflow and outflow paths of the fluid into or out of the component 01, which is embodied as a roller 01 or as a cylinder 01, are both located at the same end surface. Accordingly, the rotating union in this case is embodied with two ports, or, as is shown, is embodied with two lead-ins which are arranged coaxially in relation to one another and coaxially to the roller 01. The measurement point M4 is also arranged as close as possible to the lead-in.

In the advantageous embodiment of the temperature control device, that device has a mixing path 17, and particularly has a specially configured mixing chamber 17, in the section 12.1 between the intake point 16 and the first measurement point M1. As was mentioned above, the measurement point M1 is to be arranged close to the intake point, so that the fastest possible reaction times can be realized in the relevant control loop with the measurement point M1 and the control element 07. On the other hand, however, close downstream of the intake point, ordinarily a homogeneous mixture between infed and returning fluid, or in the heated/cooled fluid, is not yet achieved, so that errors in the measured values make control more difficult and, under certain circumstances, substantially delay the achievement of the ultimately desired temperature $\theta_3$ at the component 01.

While preferred embodiments of a method and device for controlling a printing press, in accordance with the present invention, have been set forth fully and completely herein above, it will be apparent to one of skill in the art that various changes, for example, in the specific structure of the printing press, in the structure of the at least one rotating component and the like could be made without departing from the true spirit and scope of the present invention which is to be limited only by the appended claims.

What is claimed is:

1. A method for controlling a speed of at least one rotating component of at least one printing couple of a printing press, wherein the at least one rotating component (01) of the at least one printing couple, and having a rotational speed which is variable over time, is controlled, in accordance with a target value for a temperature ($\theta_b$) which represents the component temperature of the at least one rotating component at a desired rotational speed, using a temperature control device having a response time in which the temperature control device can vary the temperature of the rotating component (20, 21), and wherein at least one drive (32) of an assembly of the printing press is at least one of regulated and controlled on the basis of a target value for said rotational speed of said at least one rotating component, which rotational speed target value, ($n_{target}$), is prescribed by a control level (31) and with regard to a rotational speed (n) that is to be maintained, characterized in that, during at least an operating phase (I) of said at least one rotating component, in which operating phase, said rotational speed of said at least one rotating component is varying over time, the rotational speed target value of said at least one rotating component ($n_{target}$), as prescribed by the control level (31), is corrected by taking into account at least one precontrol element of a path and control model of the temperature control device and relating to one of running time and time constants ($V_{LZ}$) of the temperature control device, which path and control model characterizes the response time of the temperature control device (20, 21), and by then using the resulting corrected rotational speed target value for the rotational speed ($n'_{target}$) of the at least one rotating component as a prescribed value for controlling the rotational speed (n) of the drive for the at least one rotating component (32) wherein the path and control model predicts the physical operation of the temperature control device and corrects the rotational speed target value to the corrected rotational target value in accordance with the response time of the temperature control device as characterized by the path and control model.

2. The method of claim 1, characterized in that a target value ($\theta_{b,target}$) for the temperature ($\theta_b$) which represents the component temperature and which is to be controlled is determined from the rotational speed target value ($n_{target}$) prescribed by the control level (31), and using a first rule ($F_1(n)$).

3. The method of claim 2, characterized in that to adjust the prescribed rotational speed to the response time of the temperature control device (20, 21), this target value ($\theta_{b,target}$) is modified by taking into account the at least one element of the path and control model, such that a resulting corrected target value ($\theta''_{b,target}$) for the temperature ($\theta_b$) at least partially takes the influences and the characteristics of the control path into account.

4. The method of claim 3, characterized in that a corrected target value for rotational speed ($n'_{target}$) is generated from the target value ($\theta''_{b,target}$) which has been corrected with respect to the control path, using a second rule $F_2(\theta)$.

5. The method of claim 4, characterized in that the second rule ($F_2(\theta)$) represents one of the inverse function and an inverse relation to the first rule ($F_1(n)$).

6. The method of claim 5, characterized in that the first rule ($F_1(n)$) for a dependence of a temperature ($\theta$) on a rotational speed (n) is provided in one of a processing and memory unit (37).

7. The method of claim 4, characterized in that corrected target values for rotational speed ($n'_{target}$) coming from path and control models of multiple temperature control devices (20, 21) are each evaluated with respect to their minimum.

8. The method of claim 4, characterized in that the corrected target value for rotational speed ($n'_{target}$) is weighted and is combined with the target value for rotational speed ($n_{target}$) originally prescribed by the control level (31).

9. The method of claim 4, characterized in that the second rule $F_2(\theta)$ for a dependence of a rotational speed (n) on a temperature ($\theta$) is provided in one of a processing and memory unit (37).

10. The method of claim 2, characterized in that said target value ($\theta_{b,target}$) is supplied to the control unit (21).

11. The method of claim 1, characterized in that a path and control model of a control unit (21) of the temperature control device (20, 21) is used as the path and/or control model.

12. The method of claim 11, characterized in that the control of the temperature ($\theta_b$) is carried out in the control unit (21) by means of at least two control loops connected to one another in a cascading fashion.

13. The method of claim 12, characterized in that the path and control model of an outer control loop of the control unit (21) is used as the path and control model (SRM).

14. The method of claim 1, characterized in that a precontrol element relating to heat flow rate ($V_{WF}$) which takes into account projected heat or cold losses along the control path (02) is used as an element of the path and/or control model.

15. The method of claim 1, characterized in that a precontrol relating to a targeted amplitude gain by means of a derivative action element ($V_{VH}$) is used as an additional element of the path and control model.

16. The method of claim 1 characterized in that a precontrol relating to a control element characteristic by means of a velocity limiter ($V_{AB}$) is used as an additional element of the path and control model.

* * * * *